US006349511B1

(12) United States Patent
McAlpin et al.

(10) Patent No.: US 6,349,511 B1
(45) Date of Patent: Feb. 26, 2002

(54) PREFABRICATED MULTI-SIDED BUILDING CONSTRUCTION SYSTEM

(76) Inventors: Patrick K. McAlpin, 10136 Hermosillo Dr., New Port Richey, FL (US) 34655; Manuel F. McAlpin, 55 Woodcutter La., Palm Harbor, FL (US) 34683

( * ) Notice: Subject to any disclaimer, the term of this patent is extended or adjusted under 35 U.S.C. 154(b) by 0 days.

(21) Appl. No.: 09/605,262

(22) Filed: Jun. 28, 2000

(51) Int. Cl.[7] ..... E04H 1/12

(52) U.S. Cl. ..... 52/82; 52/79.12; 52/79.6; 52/36.2; D25/1; D25/32

(58) Field of Search ..... 82/79.12, 79.9, 82/79.6, 248, 245, 36.2; D25/1, 32

(56) References Cited

U.S. PATENT DOCUMENTS

| | | | | | |
|---|---|---|---|---|---|
| 2,363,765 | A | * | 11/1944 | Fleming-Williams | 52/82 X |
| 3,119,153 | A | * | 1/1964 | Martin | 52/82 |
| 4,129,139 | A | | 12/1978 | Powers | |
| 4,426,814 | A | | 1/1984 | Stuhmer | |
| 4,720,947 | A | * | 1/1988 | Yacoboni | 52/52 X |
| 4,739,594 | A | | 4/1988 | Langford et al. | |
| 5,197,241 | A | | 3/1993 | Romeo | |
| 5,216,854 | A | * | 6/1993 | Emmert | 52/82 X |
| 5,383,313 | A | * | 1/1995 | Deeke et al. | 52/82 |
| D357,769 | S | * | 4/1995 | Connelly | 52/82 X |
| 5,671,568 | A | | 9/1997 | Armanno, Sr. | |

* cited by examiner

*Primary Examiner*—Robert Canfield
(74) *Attorney, Agent, or Firm*—Larson & Larson, P.A.; James E. Larson

(57) ABSTRACT

A gazebo is fabricated utilizing a novel construction system wherein lightweight aluminum framing components are employed. A preferred structure has eight sides wherein each side includes a pair of vertical posts, a pair of header members, a rail and foot member, columns disposed between the rail and foot member and the pair of header members, and an insulated composite roof panel. An entrance way is void of the rail and foot member, but can be employed with the necessary framing components to attach a door. As each side unit is attached by self mating beam and vertical post members to an adjacent side unit, the gazebo structure is formed. A crown portion can be attached upon an apex of the gazebo. Shingles or tiles can be attached upon the roof panels. Spline grooves formed along the vertical posts permit the gazebo to be "screened in." A strengthening wire can also be employed around the circumference of the gazebo through each side unit upper header member for adding structural integrity to the gazebo.

24 Claims, 10 Drawing Sheets

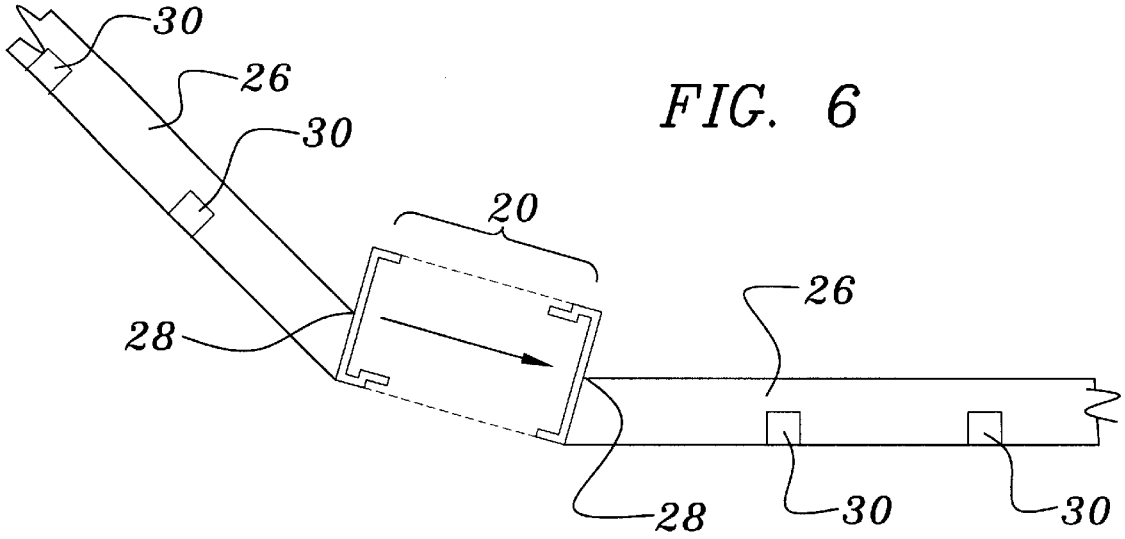
FIG. 6
FIG. 7
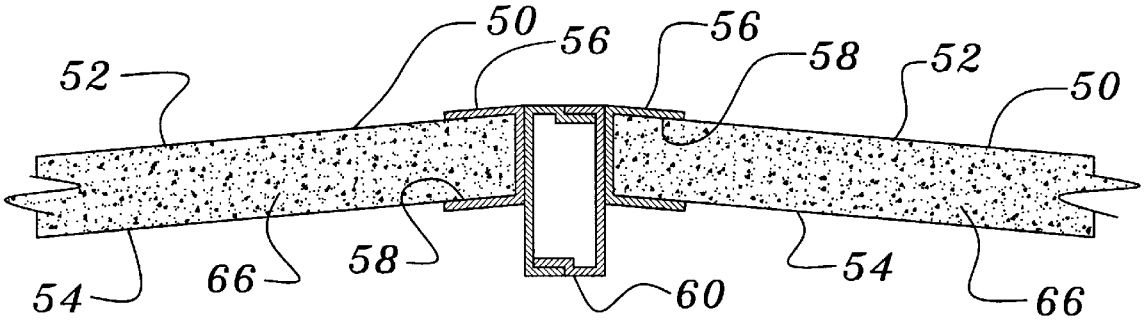
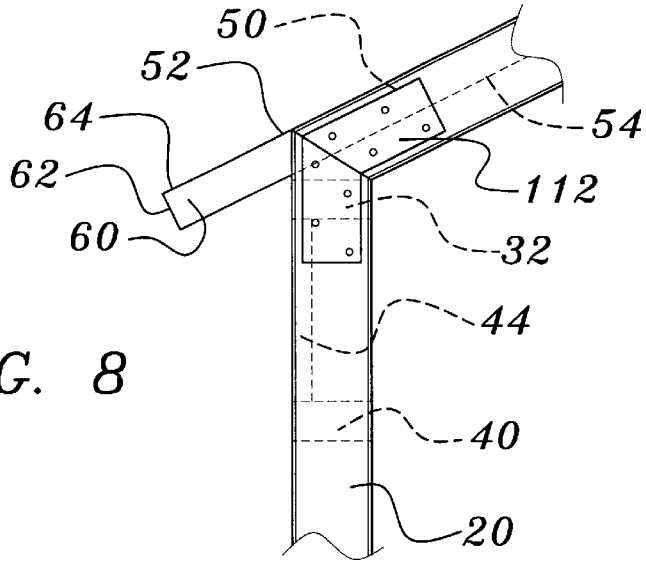
FIG. 8

FIG. 10A
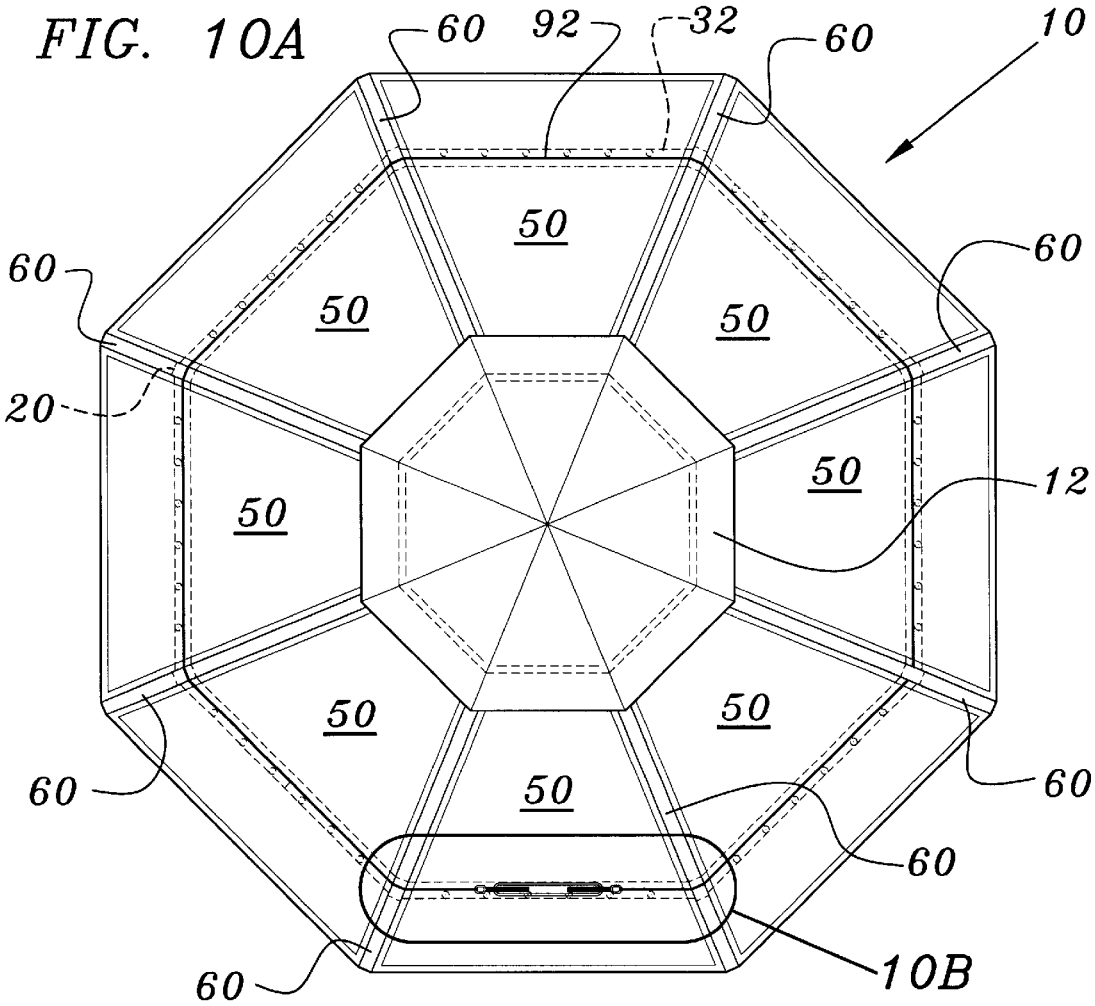
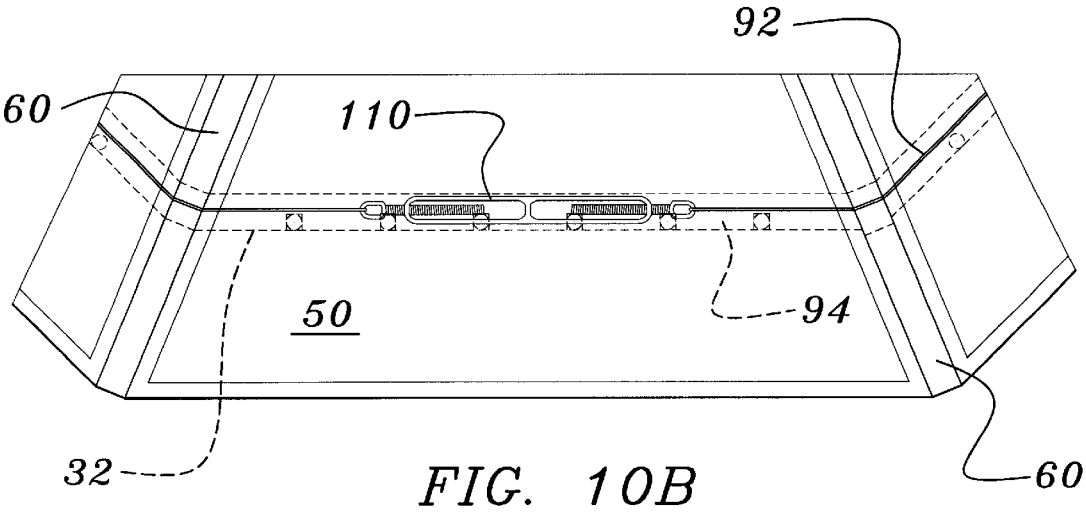
FIG. 10B

PREFABRICATED MULTI-SIDED BUILDING CONSTRUCTION SYSTEM

BACKGROUND OF THE INVENTION

1. Field of the Invention

This invention relates to a prefabricated multi-sided building construction system. More particularly, it relates to a prefabricated multi-sided building construction system which results in the fabrication of a gazebo which utilizes lightweight structural framing components and insulated composite roof panels.

2. Description of Prior Art

Multi-sided building structures are well known in the prior art. One type of multi-sided building structure includes gazebos. Gazebos are usually constructed as small polygonal structures situated in an area of a multi-family residence, single family home, or park. Typically, gazebos have six or eight sides. Most gazebos are used in the warm months of seasonal climates (i.e., the Northeast, Midwest and Northeast regions of the U.S.) but can be used all year in year-round warm climates (i.e., the Southeast and Southwest regions of the U.S.). Gazebos are usually not constructed to be used as permanent enclosures, but usually as "summer" structures. However, they can include windows and doors and thereby provide a minimal amount of protection from the bad elements of weather in those months that subject the environment to harsher weather conditions.

Most gazebos are constructed from wood, representing the most common form of material used in their construction. After assembly, the gazebo can be painted in a variety of colors to add aesthetic appeal. However, painted wood fades and thereby requires maintenance over time, representing a deficiency in known prior art gazebos. Further, wood gazebos have difficulty in combating the harsh winter climates seen in the north. Wood can quickly rot over time due to being subjected to rain, snow and ice. This causes many people to refrain from constructing gazebos on their property since the required maintenance of the structure outweighs the pleasure received from the use thereof. Still further, it is quite common to employ a hot tub or spa underneath a gazebo. Gazebos constructed from wood deteriorate quickly due to the hot moisture rising from the spa.

Still even further, many people simply do not possess the necessary skill that is required to assemble a gazebo. It is therefore necessary, in many cases, to hire a professional to assist in assembling the gazebo. This results in a rise in cost and is another factor in convincing people to refrain from having a gazebo constructed on their property. Even in the case where an individual is "handy", assembling known gazebos, be they prefabricated or not, requires a great deal of time—a luxury that many individuals simply do not have to today's fast pace society.

Some improvements upon exiting known gazebos have contemplated the use of materials other than wood. However, none to date have been easy to manufacture or to assemble, let alone provide any great reduction in the overall cost to the consumer.

It would therefore be advantageous to provide an improved gazebo construction system that overcomes the deficiencies seen in the prior art. The improved gazebo construction system should be easy to assemble and preferably be prefabricated. The use of lightweight components, which requires minimal maintenance, should be used to overcome the problems seen in prior art wood-type structure systems. However, the improved structure should employ components that can withstand the elements of weather such that the gazebo could be used in cold weather climates and be impervious to rain, snow, ice and other known weather elements which can cause damage to the structure (i.e., wind). Finally, the improved gazebo should maintain the aesthetic qualities seen with wood-style structures wherein decorative roofing, windows, and doors can be employed.

SUMMARY OF THE INVENTION

I have invented an improved gazebo construction system which results in a gazebo which is impervious to bad weather, has great structural integrity, provides means to employ doors, screening and/or windows, all the while being lightweight, cost effective and aesthetically pleasing to the eye.

In particular, my gazebo construction system employs lightweight aluminum framing components that can be quickly attached by either a self-mating method or by screws. Further, my improved novel system utilizes insulated composite roof panels thereby providing a higher level of structural integrity as compared to prior art gazebo construction systems as well as improving the insulation of the gazebo. Since my roof panels snap together quickly, a professional assembler is not needed. In fact, my system provides for prefabricated sections which makes assembly of the gazebo quick and easy. My gazebo construction system provides that each side wall and roof section be prefabricated as a single unit and sold as a group of units. Depending on the amount of sides (six or eight, for example), the assembler simply stands each section in a vertical position and attaches the appropriate adjacent side section until the gazebo is formed.

Upon assembling the side walls and roof panels, a crown member is attached on an apex portion of the gazebo in a similar manner in which each side section was attached (each section of the crown being prefabricated). Thereafter, roof shingles or tiles can be secured to the roof sections using a variety of different components, such as for example, individual shingles or tiles, a sheet of prefabricated shingles or tiles, or a sheet of metal roofing components.

Finally, screening, windows and a door can be employed with my novel gazebo construction system. If screening is employed, a spline groove formed along the aluminum framing components is used to receive the screening material. If windows are to be employed they can be attached in a variety of manners, such as for example, by screws. If a door is to be used, an additional foot member is attached along a bottom portion of an open side section (entrance way) of the gazebo along with a pair of additional vertical side posts.

Finally, my novel gazebo construction system can employ a strengthening wire around the circumference of the gazebo to add integrity to the structure by pulling each side unit tightly together.

BRIEF DESCRIPTION OF THE DRAWINGS

The invention may be best understood by those having ordinary skill in the art by reference to the following detailed description when considered in conjunction with the accompanying drawings in which:

FIG. 6 is a partial top plan view of a rail member employed in my novel construction system illustrating how two adjacent header members attach by a vertical post member;

FIG. 7 is a sectional view along lines 7—7 of FIG. 4 illustrating how two adjacent roof panels employed in my novel construction system attach by a beam member;

FIG. 8 is a detail view of FIG. 4 illustrating how a vertical post member attaches to the roof panel;

FIG. 10A is a top plan view of a gazebo formed by my novel construction system illustrating the employment of a strengthening wire around the circumference of the gazebo;

FIG. 10B is a detail view of a portion of FIG. 10A illustrating how the strengthening wire attaches around the circumference of the gazebo within a cavity of a header member of the gazebo;

DETAILED DESCRIPTION OF THE INVENTION

Figure 1:
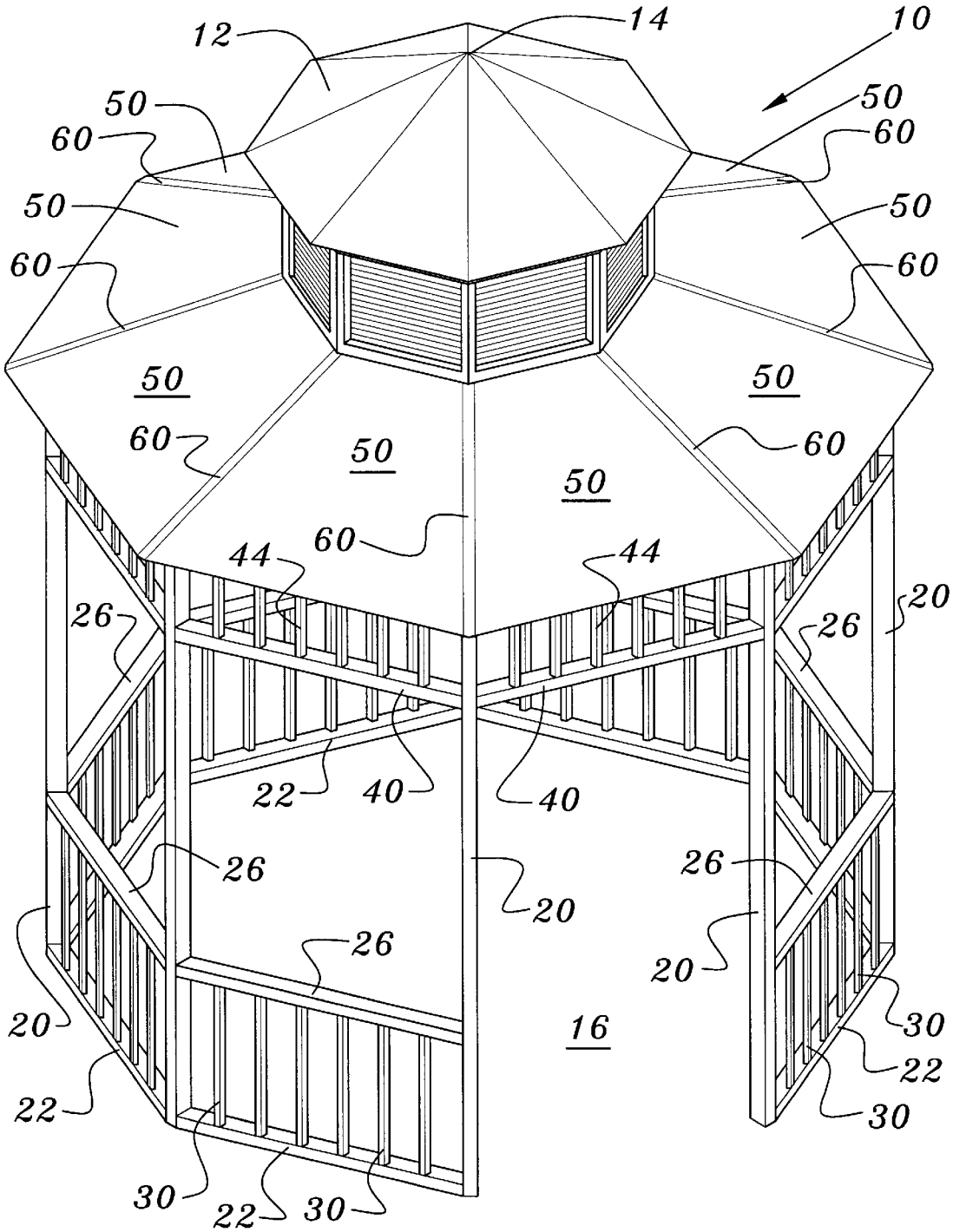
FIG. 1 is a perspective view of a gazebo formed by my novel construction system.

Throughout the following detailed description, the same reference numerals refer to the same elements in all figures.

Referring to FIG. 1, a multi-sided structure, or gazebo, 10 is shown that is formed utilizing a novel construction system of the present invention. As shown, gazebo 10 is an eight sided polygonal structure, representing the preferred embodiment for the present invention. However, alternate embodiments can include more than eights sides (i.e., six, ten, twelve sides etc . . . ). It is also noted that in the preferred embodiment, gazebo 10 is an equilateral polygonal structure, as shown in FIG. 1. However, in an alternate embodiment (although not shown), gazebo 10 can be an irregular polygonal structure wherein, for example, a pair of opposed parallel sides have a greater width than all of the other remaining sides, which gives gazebo 10 an oblong appearance.

With continuing reference to FIG. 1, gazebo 10 further includes a crown portion 12 mounted upon an apex 14. As shown, crown portion 12 contains the same number of sides that the main portion of the gazebo contains. Accordingly, in the preferred embodiment, crown portion 12 has eight sides.

Further to FIG. 1, it is shown that one side section of gazebo 10 provides an entrance way 16, which is void of certain components (to be further discussed hereinafter). Entrance 16 can include a footer member (not shown) and a pair of additional vertical post members (also not shown) for attaching a door (also not shown).

Figure 2:
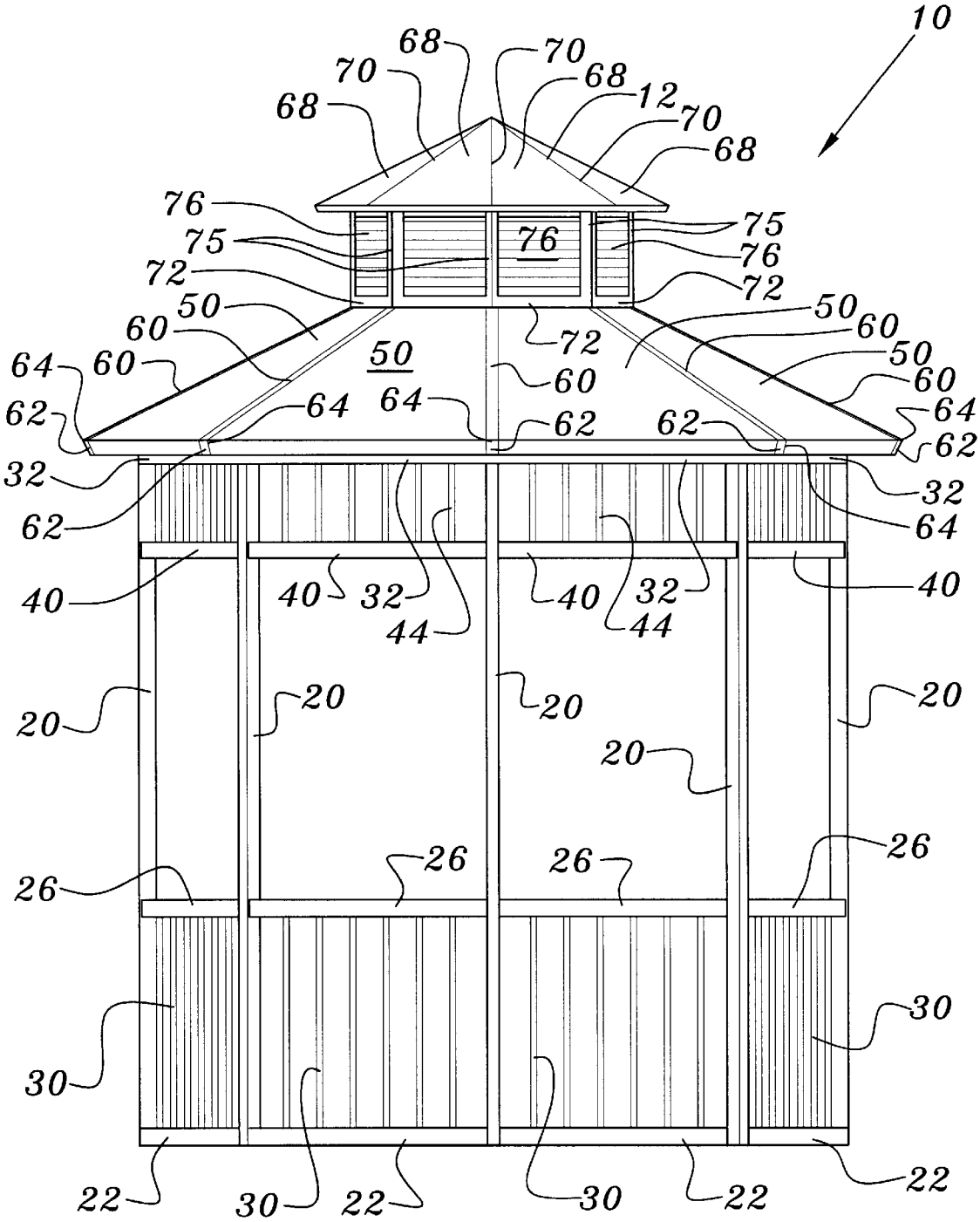
FIG. 2 is a side elevational view of a gazebo formed by my novel construction system.
Figure 3:
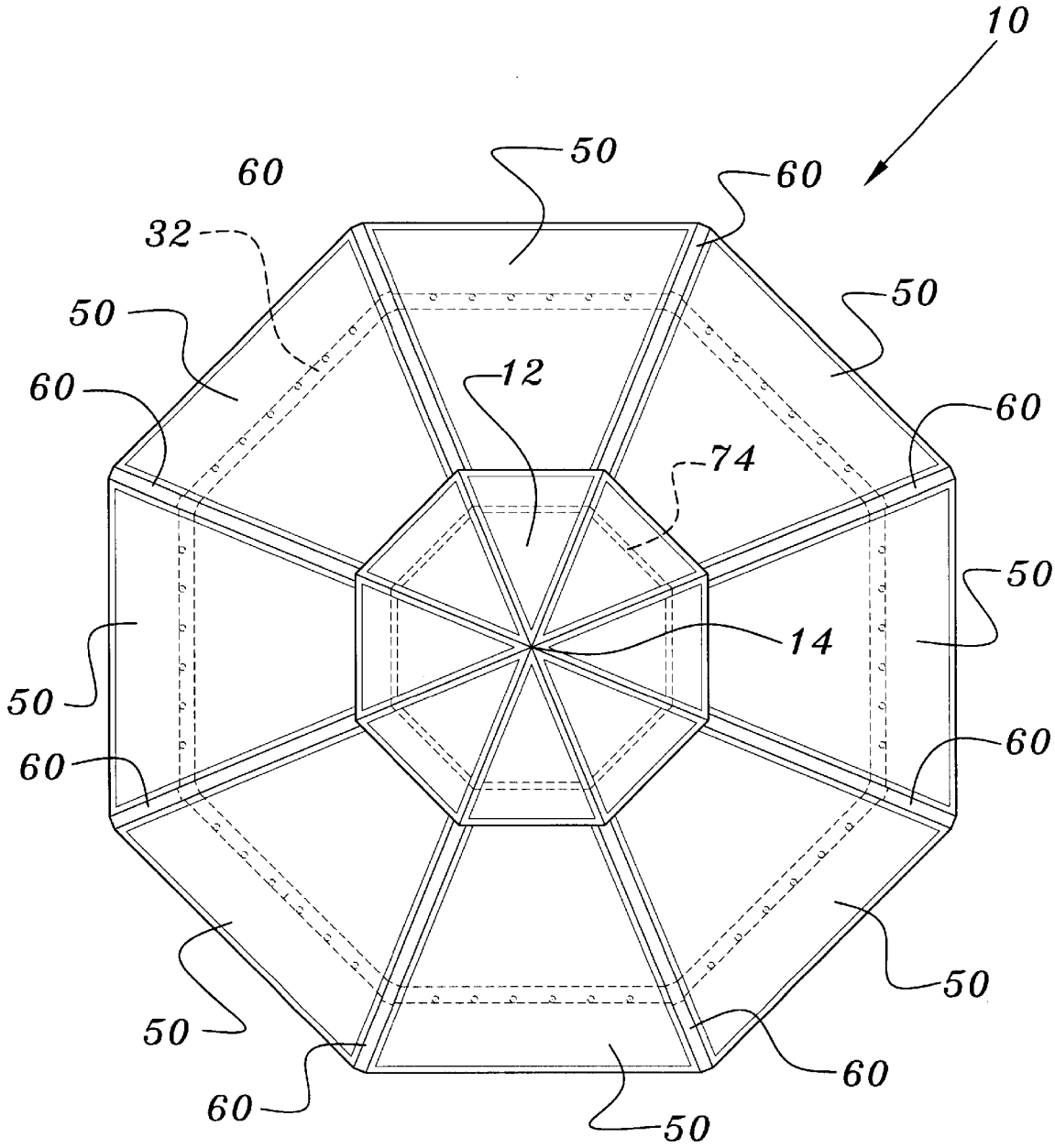
FIG. 3 is a top plan view of a gazebo formed by my novel construction system, the broken line representing a portion of the framing components used in the construction system.
Figure 4:
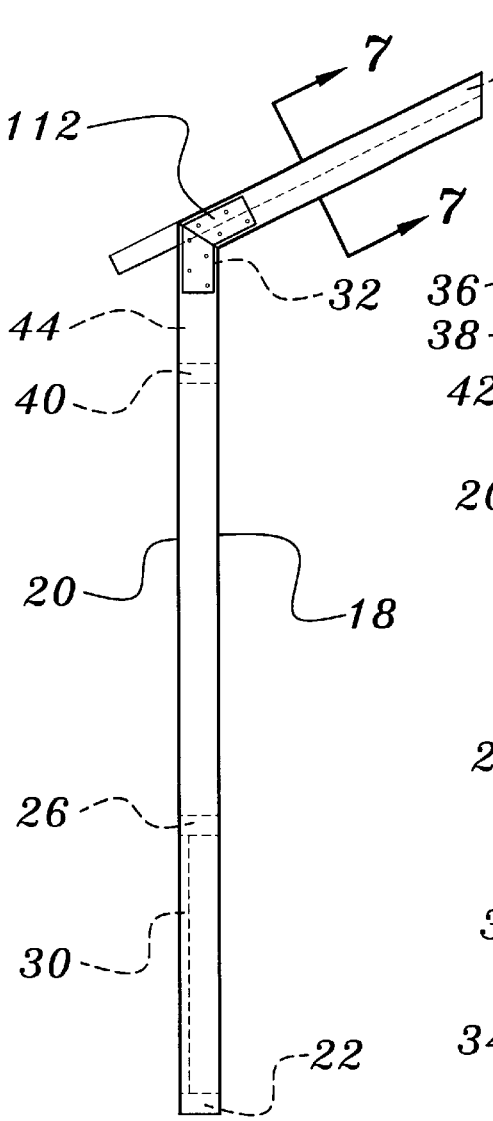
FIG. 4 is a side elevational view of a single side unit employed in the gazebo formed by my novel construction system.
Figure 5:
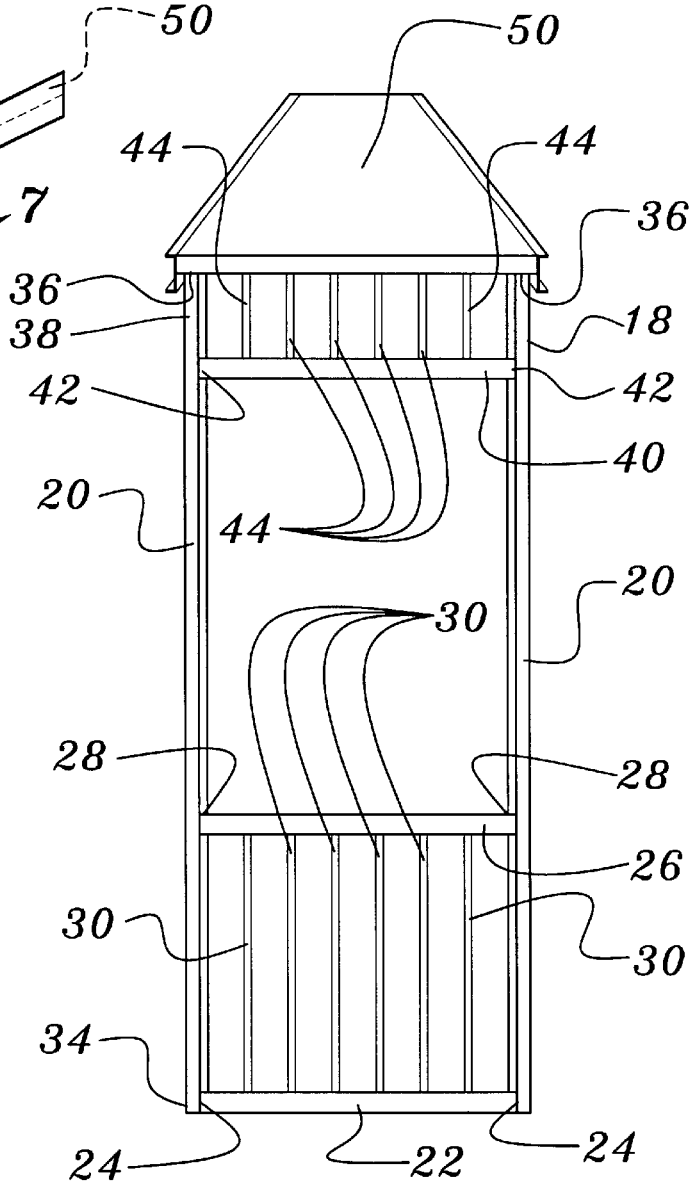
FIG. 5 is a front elevational view the single side unit employed in the gazebo formed by my novel construction system.

Referring to FIG. 2, which is a side elevational view of FIG. 1, it is shown that the novel construction system that forms gazebo 10 employs a plurality of different framing components. In the preferred embodiment, lightweight aluminum framing components are employed. However, high strength vinyl could be employed with the gazebo construction system of the present invention. Referring to FIGS. 4 and 5, it is shown that my novel construction system provides that a single side unit 18 can be prefabricated and sold in a package of eights units, for example, to form the preferred eight sided gazebo. With continuing reference to FIG. 5, it is shown that each side unit 18 (except that of the entrance way 16) includes a pair of vertical post members 20, a foot member 22 attached perpendicularly at opposed ends 24 to vertical post members 20 at a lower end 34 of side unit 18, a rail member 26 mounted above foot member 22 and attached perpendicularly at opposed ends 28 to vertical post members 20, a plurality of lower column members 30, disposed in a parallel relation to vertical post members 20 between foot and rail members 22 and 26 respectively, an upper header member 32 (see FIG. 4) attached perpendicularly at opposed ends 36 (see FIG. 5) to vertical post members 20 at an upper end 38 of side unit 18, a lower header member 40 mounted below upper header member 32 and attached perpendicularly at opposed ends 42 to vertical post members 20, and a plurality of upper column members 44, disposed in a parallel relation to vertical post members 20 between upper and lower header members 32 and 40 respectively.

Figure 13:
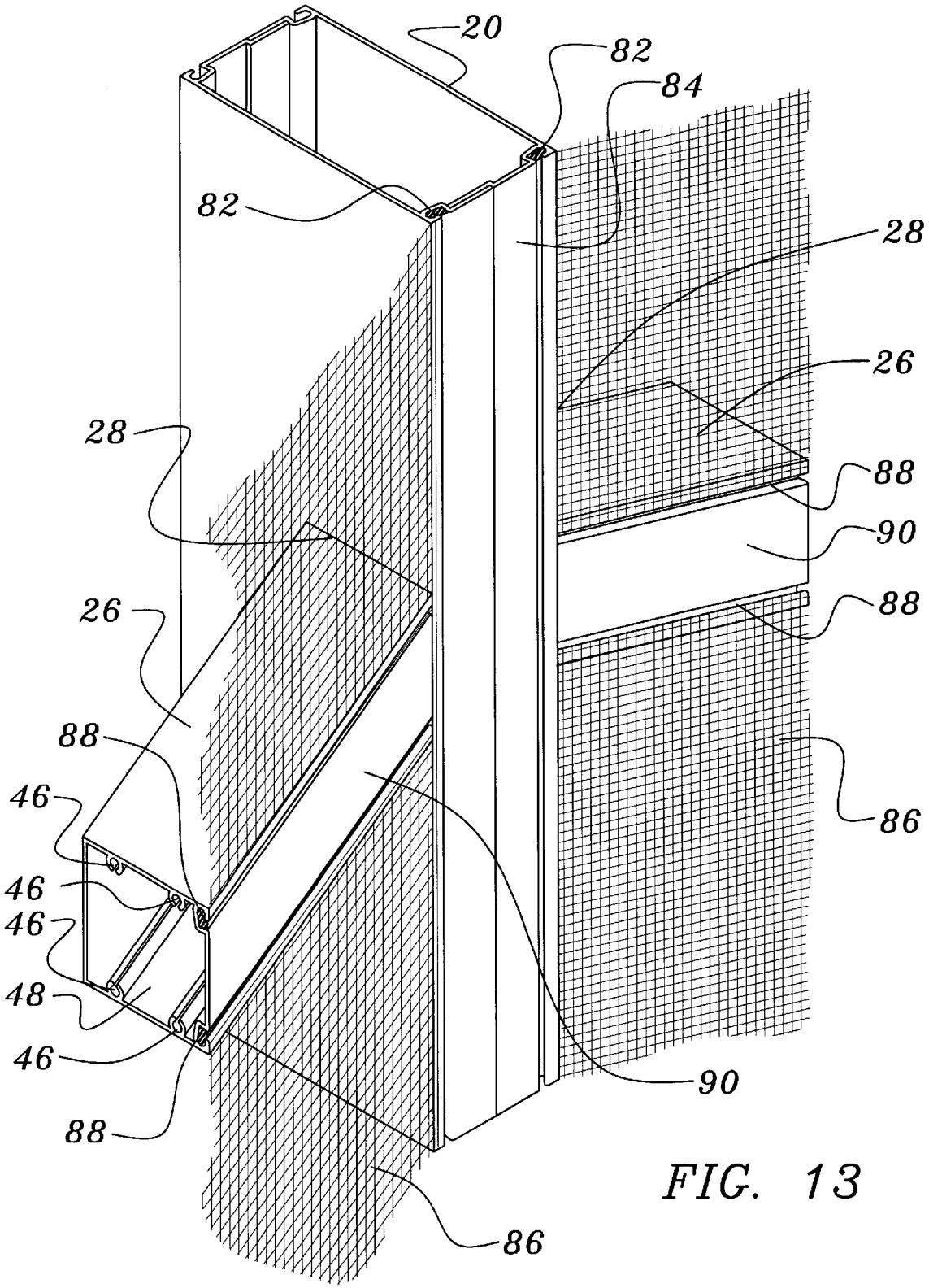
FIG. 13 is a partial view of a vertical post member and a pair of adjacent rail members illustrating how screening can be employed with the gazebo formed by my novel construction system.

As shown in FIG. 13, the preferred embodiment, rail members 26 are formed from a single integral piece of aluminum containing a set of screw channels 46 mounted within an inner cavity 48. Screw channels 46 permit rail members 26 to be mounted to vertical post members 20 by a set of four screws (not shown) at each rail member opposed end 28. Further, although not shown, foot member 22, upper header member 32 and lower header member 40 are formed from identical pieces of aluminum as rail member 26 and therefore attach to vertical post members 20 in an identical manner at each set of respective opposed ends, 24, 36 and 42. In an alternate embodiment, rail member 26, foot member 22, upper header member 32 and lower header member 40 could be formed from two pieces of "mating" aluminum (self-mating or screw attached) to form each respective member.

Referring back to FIG. 5, it is shown that each side unit 18 contains a roof panel 50. As shown in FIG. 7, the preferred embodiment, roof panel 50 is an insulated composite panel having an inner core 66 made from foam. Further, roof panel 50 has a top wall 52 and a bottom wall 54 which insert within a c-channel member 56 at a side portion 58. C-channel member 56 mounts to a side of a beam 60 to assist in forming the overall roof of gazebo 10. Beam 60 is fashioned from a pair of mating members, which in the preferred embodiment self align, and which are then subsequently attached by screws. However, in alternate embodiments, the pair of mating members can be self-mating, such as for example, the Snap-N-Lock® system. It is further noted that vertical post members 20 are also fashioned in the same manner as beam 60, as shown in FIGS. 6 and 13. Referring to FIG. 8, it is shown how each vertical post member 20 attaches to each respective beam 60 by a gusset plate 112.

Referring to FIGS. 1 and 2, it is shown that roof panels 50 are generally "pie-shaped." Since roof panel 50 extends further out from that of beam 60 (see FIGS. 4 or 8), a cap member 62 can be placed over an end portion 64 of beam 60 to give gazebo 10 a "finished" look, such as depicted in FIGS. 1 and 2.

As shown in FIGS. 1 and 2, crown portion 12 also includes a set of roof panels 68, which are made from the same insulated composite roof panel material employed with roof panels 50, but are cut to smaller sizes. Crown portion roof panels 68, however, are self-mating and do not require the use of a beam member. Accordingly, prior to any further material being placed upon crown portion roof panels 68, a seam 70 is provided between any two adjacent panels 68 after being attached to one another. In the preferred embodiment, the Snap-N-Lock® system can be employed for crown portion roof panels 68. Crown portion 12 further includes footers 72, headers 74, posts 75 and side panels 76, thereby providing a closed and finished appearance. If desired, lattice work could be provided for crown portion side panels 76. However, to keep elements, such as rain, from seeping into gazebo 10, it is desirable to use a solid panel which precludes the passing of water. Still other panels can be employed and include, but of course are not limited to, columns, pickets, glass or vinyl windows and stained glass.

Figure 9:
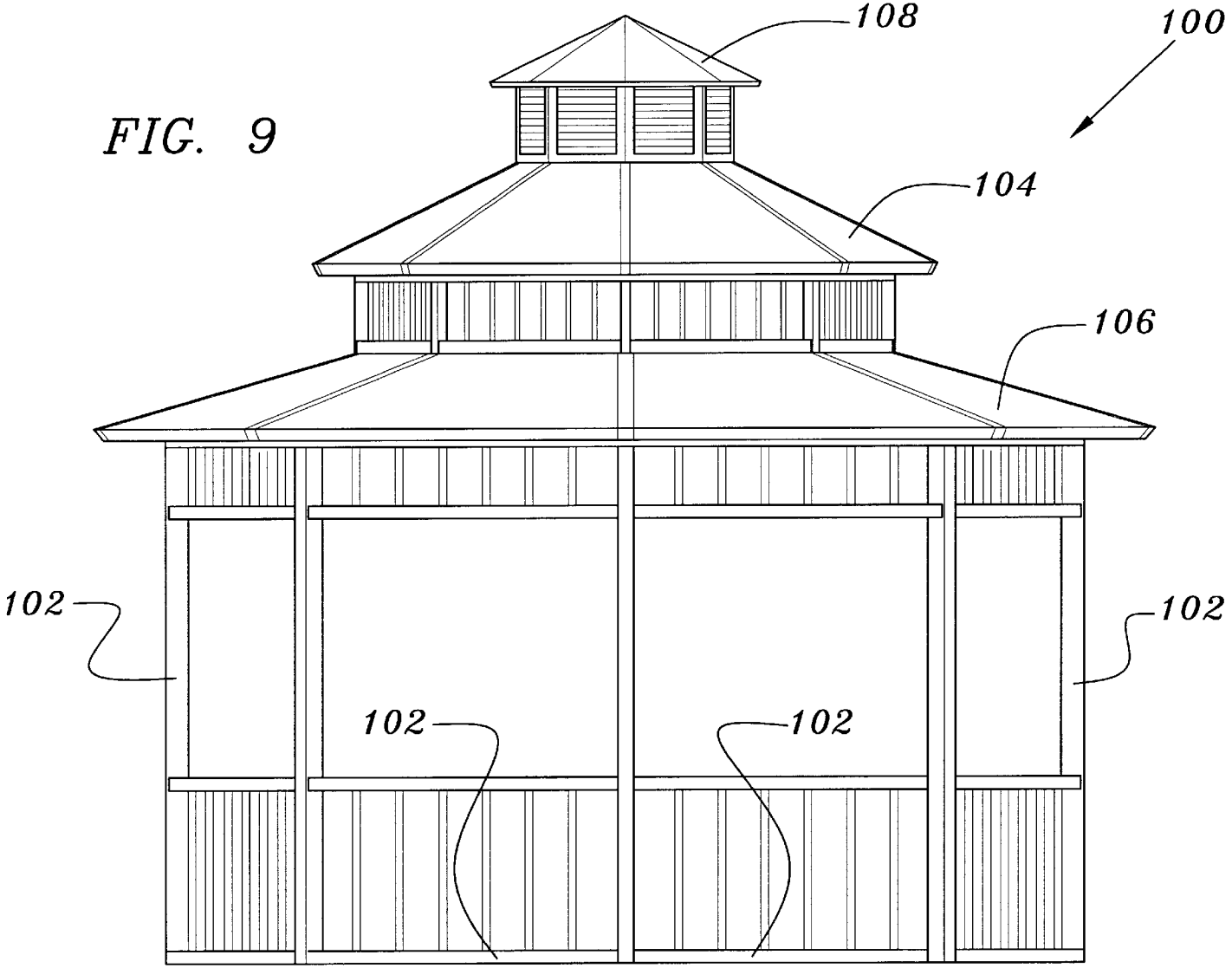
FIG. 9 is a side elevational view of a first alternate embodiment of a gazebo formed by my novel construction system.

Referring to FIG. 9, an alternate gazebo 100 is shown which is constructed in the same manner as gazebo 10, except that it contains wider single side units 102, and a second roof layer 104 positioned between a first roof layer 106 and a crown portion 108.

Figure 11:
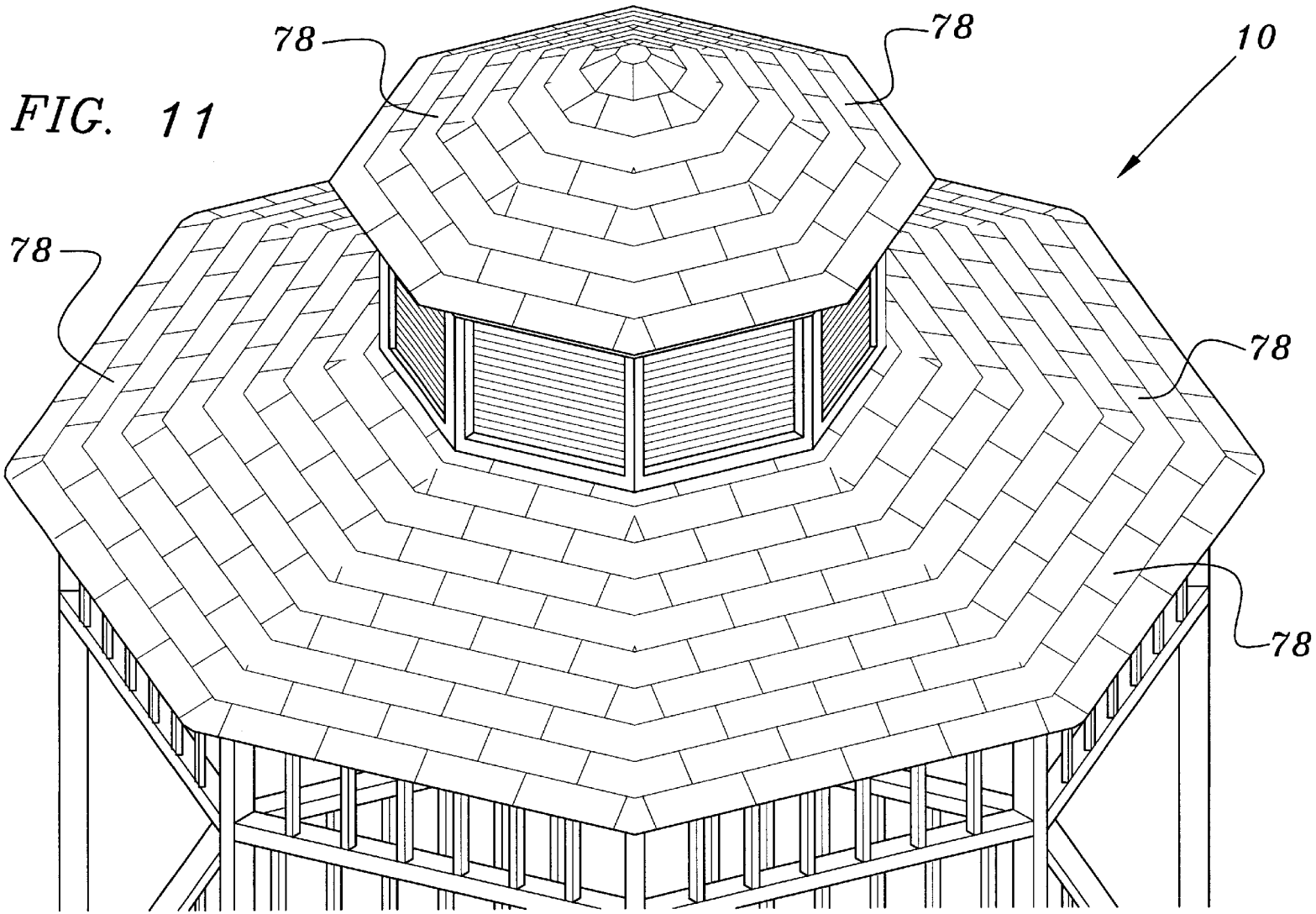
FIG. 11 is a partial perspective view of a gazebo formed by my novel construction system illustrating how individual shingles can be attached to the roof panels.
Figure 12:
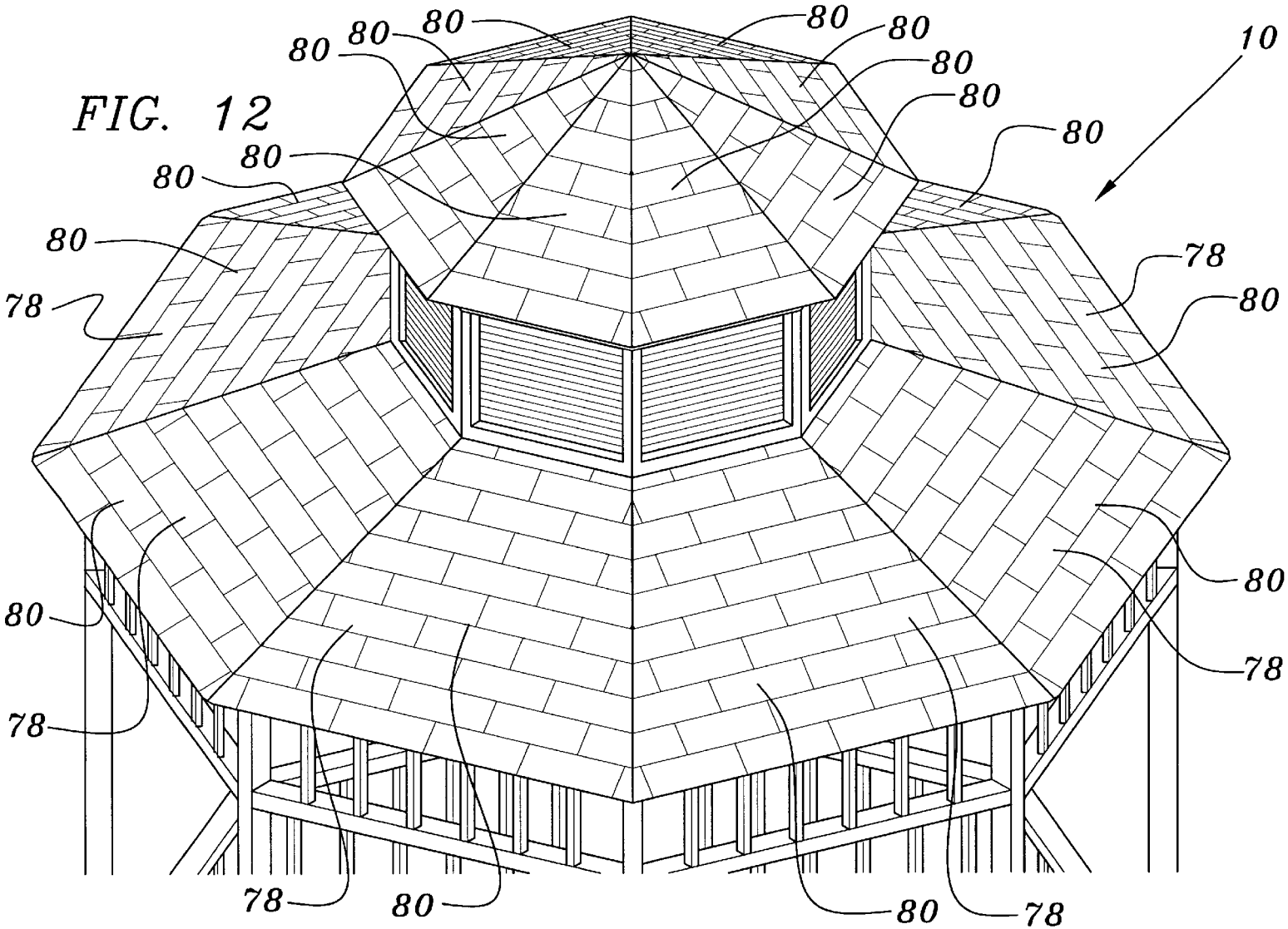
FIG. 12 is a partial perspective view of a gazebo formed by my novel construction system illustrating how a prefabricated sheet of shingles can be attached to each roof panel.

Referring to FIGS. 11 and 12, it is shown that the constructed roof can be covered with a roofing material, such as for example, shingles. FIG. 11 depicts how individual shingles 78 can attach to the roof utilizing any of a variety of known methods. FIG. 12, however, depicts a system which utilizes sheets 80 of shingles 78 which are cut to the same size of each roof panel 50 (not shown in FIG. 12) attached thereunder. Further, although not shown, a variety of other roofing materials could be employed, such as for example, concrete roof tiles, metal sheeting and metal tiles.

Referring to FIG. 13, each vertical post 20 contains a pair of vertically disposed spline grooves 82 formed along a back wall 84 of each post member 20. Spline grooves 82 can be used to receive screening material 86 to enclose the entire open area of each side unit 18 of gazebo 10. As further shown in FIG. 13, rail members 26 contain a pair of horizontally disposed spline grooves 88 formed along a back wall 90 of each rail member 26. If desired, only a portion of the area of each side unit 18 can be screened using rail member spline grooves 88 such that the area between rail member 26 and foot member 22 is screened. This may be used to prevent small children or animals from extending any body portions through lower column members 30. In an alternate embodiment, the screening can be replaced by windows containing glass or a combination of glass and screening whereby the glass portion can be left closed to prevent undesirable weather elements from passing into gazebo 10 or opened to permit air to flow into gazebo 10.

As shown in FIG. 10A, gazebo 10 can further include a strengthening wire 92 for adding structural integrity to gazebo 10. In particular, strengthening wire 92 wraps around the circumference of gazebo 10 and inwardly pulls each side unit 18 together. In the preferred embodiment, wire 92 fishes within each cavity 94 of each upper header member 32 and joins within a single cavity 94 of an upper header member 32. Referring to FIG. 10B, a detail of FIG. 10A, it is shown that wire 92 can be fastened at opposed ends within entryway upper header member 32 by a turn buckle 110.

Finally, although not shown, gazebo 10 can include a plurality of chases employed within the side walls and roof panels for fishing electrical and/or plumbing fixtures through out the structure such that a water supply, electrical outlets, lights and fans can be employed with gazebo 10.

Equivalent elements can be substituted for the ones set forth above such that they perform the same function in the same way for achieving the same result.

What is claimed is:

1. A prefabricated multi-sided structure construction system comprising:

a) a plurality of vertical side units each having a top and bottom portion, i) each vertical side unit attached to an adjacent vertical side unit for forming a circumference of the multi-sided structure, ii) each vertical side unit including a pair of opposed vertical support members, a header member and a foot member, the header member perpendicularly attached between the pair of vertical support members at opposed ends at the vertical side unit top portion, the foot member perpendicularly attached between the pair of vertical support members at opposed ends at the vertical side unit bottom portion, iii) each vertical side unit attaching to an adjacent vertical side unit by one of the pair of opposed vertical support members mating with one of the pair of opposed vertical support members of the adjacent vertical side unit, b) a vertical entranceway unit having a top and bottom portion, a pair of vertical support members and a header member attached to the pair of vertical support members at opposed ends at the vertical entranceway unit top portion, the vertical entranceway unit disposed between two of the plurality of vertical side units such that one each of the pair of vertical entranceway unit vertical support members mates with an adjacent vertical side unit vertical support member on each side of the vertical entranceway unit, the vertical entranceway unit permitting a person to enter within circumference of the multi-sided structure, c) a plurality of roof panels, one each mounted above each of the plurality of vertical side units and the vertical entranceway side unit, each roof panel having a front and back end and a pair of opposed side portions, each roof panel front end having a length longer than that of each roof panel back end, each roof panel mating with an adjacent roof panel at each opposed side portion to form a first roof layer over the top portions of the plurality of vertical side units and the vertical entranceway unit, each roof panel having a top and bottom surface and an insulator disposed therebetween, and d) a plurality of rail members, one each perpendicularly mounted at opposed ends between each pair of vertical side unit opposed vertical support members and above each vertical side unit foot member.

2. The prefabricated multi-sided structure construction system of claim 1, further comprising:

a) a plurality of column members intermediately mounted at a perpendicular angle between each vertical side unit rail and foot member in a spaced parallel relationship.

3. The prefabricated multi-sided structure construction system of claim 1, further comprising a crown portion mounted on an apex of the multi-sided structure first roof layer, the crown portion having a plurality vertically disposed side walls and a second roof layer including a plurality of self-mating second roof panels mounted upon top edges of the crown portion plurality of vertically disposed side walls.

4. The prefabricated multi-sided structure construction system of claim 1, wherein each vertical side unit header and foot member includes an inner cavity and a plurality of screw channels disposed within the inner cavity for receiving screws and attaching each header and foot member to each vertical side unit vertical support member.

5. The prefabricated multi-sided structure construction system of claim 1, wherein a vertical post is formed when one of the pair of opposed vertical support members of a first vertical side unit mates with one of the pair of opposed vertical support members of a second adjacent vertical side unit.

6. The prefabricated multi-sided structure construction system of claim 5, wherein the two vertical support members that form a vertical post are held together by a plurality of screws.

7. The prefabricated multi-sided structure construction system of claim 5, further comprising a plurality of spline grooves formed along an inner surface of each vertical post and along an inner surface of each vertical side unit header and foot member for receiving screening material.

8. The prefabricated multi-sided structure construction system of claim 1, wherein the pair of opposed side portions on each roof panel mounts within a c-channel member along the entire length thereof, each c-channel attached to a connection member for mating with a reciprocal connection member of an adjacent roof panel such that a beam is formed between two adjacent roof panels when each roof panel mates with the adjacent roof panel.

9. The prefabricated multi-sided structure construction system of claim 8, wherein the two connection members that form a beam are held together by a plurality of screws.

10. The prefabricated multi-sided structure construction system of claim 1, wherein the vertical side unit opposed vertical support, header and foot members and the vertical entranceway unit opposed vertical support and header members are made from extruded aluminum.

11. The prefabricated multi-sided structure construction system of claim 1, further comprising a plurality of shingles mounted upon the top surfaces of the plurality of roof panels.

12. The prefabricated multi-sided structure construction system of claim 11, wherein the plurality of shingles are mounted on a plurality of planar sheets, one planar sheet of shingles each mounted upon the top surface of each of the plurality of roof panels.

13. The prefabricated multi-sided structure construction system of claim 1, further comprising a strengthening wire inserted around the circumference of the multi-sided structure through a cavity formed in each vertical side unit header member and the vertical entranceway unit header member, the wire having a first and second end and terminating at a common point, each end attaching to a separate eye bolt.

14. The prefabricated multi-sided structure construction system of claim 1, wherein the structure is an eight-sided gazebo employing seven vertical side units, a single entranceway side unit and eight roof panels.

15. A prefabricated gazebo construction system comprising:

a) a plurality of vertical side units each having a top and bottom portion, and i) each vertical side unit attached to an adjacent vertical side unit for forming a circumference of the gazebo, ii) each vertical side unit including a pair of opposed vertical support members, upper and lower header members, a rail member and a foot member, the upper and lower header members perpendicularly attached between the pair of vertical support members at respective opposed ends proximal to the vertical side unit top portion, the upper header member mounted above the lower header member in a spaced parallel relationship, the rail and foot member perpendicularly attached between the pair of vertical support members at respective opposed ends proximal to the vertical side unit bottom portion, the rail member mounted above the foot member in a spaced parallel relationship, iii) a plurality of upper column members intermediately mounted at a perpendicular angle between each vertical unit side upper and lower header member in a spaced parallel relationship, iv) a plurality of lower column members intermediately mounted at a perpendicular angle between each vertical unit side rail and foot member in a spaced parallel relationship, v) each vertical side unit attaching to an adjacent vertical side unit by one of the pair of opposed vertical support members mating with one of the pair of opposed vertical support members of the adjacent vertical side unit, b) a vertical entranceway unit having a top and bottom portion, a pair of vertical support members and a header member attached to the pair of vertical support members at opposed ends at the vertical entranceway unit top portion, the vertical entranceway unit disposed between two of the plurality of vertical side units such that one each of the pair of vertical entranceway unit vertical support members mates with an adjacent vertical side unit vertical support member on each side of the vertical entranceway unit, the vertical entranceway unit permitting a person to enter within circumference of the gazebo, and c) a plurality of roof panels, one each mounted above each of the plurality of vertical side units and the vertical entranceway side unit, each roof panel having a front and back end and a pair of opposed side portions, each roof panel front end having a length longer than that of each roof panel back end, each roof panel mating with an adjacent roof panel at each opposed side portion to form a first roof layer over the top portions of the plurality of vertical side units and the vertical entranceway unit, each roof panel having a top and bottom surface and an insulator disposed therebetween.

16. The prefabricated gazebo construction system of claim 15, further comprising a crown portion mounted on an apex of the gazebo first roof layer, the crown portion having a plurality vertically disposed side walls and a second roof layer including a plurality of self-mating second roof panels mounted upon top edges of the crown plurality of vertically disposed side walls.

17. The prefabricated gazebo construction system of claim 15, wherein each vertical side unit upper and lower header and rail and foot member includes an inner cavity and a plurality of screw channels disposed within the inner cavity for receiving screws and attaching each member to each vertical side unit vertical support member.

18. The prefabricated gazebo construction system of claim 15, wherein a vertical post is formed when one of the pair of opposed vertical support members of a first vertical side unit mates with one of the pair of opposed vertical support members of a second adjacent vertical side unit, each vertical post held together by a plurality of screws.

19. The prefabricated gazebo construction system of claim 18, further comprising a plurality of spline grooves formed along an inner surface of each vertical post and along an inner surface of each vertical side unit header and foot member for receiving screening material.

20. The prefabricated gazebo construction system of claim 15, wherein the pair of opposed side portions on each roof panel mounts within a c-channel member along the entire length thereof, each c-channel attached to a connection member for mating with a reciprocal connection member of an adjacent roof panel such that a beam is formed between two adjacent roof panels when each roof panel mates with the adjacent roof panel, each two connection members that form each beam held together by a plurality of screws.

21. The prefabricated gazebo construction system of claim 15, further comprising an upper roof portion mounted upon the first roof layer and including a plurality side wall portions supporting a set of second roof panels, each of the second set of roof panels having a smaller area than each roof panel of the first roof layer plurality of roof panels, the number of upper roof portion side walls being equal to the number of gazebo sides.

22. The prefabricated gazebo construction system of claim 21, further comprising a crown portion mounted on an apex of the gazebo upper roof portion, the crown portion having a plurality vertically disposed side walls and a second roof layer including a plurality of self-mating second roof panels mounted upon top edges of the crown plurality of vertically disposed side walls.

23. The prefabricated gazebo construction system of claim 15, further comprising a plurality of shingles mounted upon the top surfaces of the plurality of roof panels.

24. The prefabricated gazebo construction system of claim 15, further comprising a strengthening wire inserted around the circumference of the gazebo through a cavity formed in each vertical side unit header member and the vertical entranceway unit header member, the wire having a first and second end and terminating at a common point, each end attaching to a separate eye bolt.

* * * * *